US007320414B2

(12) United States Patent
Davis

(10) Patent No.: US 7,320,414 B2
(45) Date of Patent: Jan. 22, 2008

(54) BEVERAGE DISPENSE

(76) Inventor: Terrence Robert Davis, 18 Chesterton Close Hunt End, Redditch, Worcester B97 5XS (GB)

( * ) Notice: Subject to any disclaimer, the term of this patent is extended or adjusted under 35 U.S.C. 154(b) by 380 days.

(21) Appl. No.: 10/615,997

(22) Filed: Jul. 8, 2003

(65) Prior Publication Data

US 2004/0099688 A1 May 27, 2004

(51) Int. Cl.
*B67D 5/56* (2006.01)

(52) U.S. Cl. ..... 222/129.1; 222/129.4; 222/145.1; 222/145.5; 222/504; 222/571

(58) Field of Classification Search ..... 222/129.1, 222/132, 129.4, 571, 129.3, 135, 145.1, 504, 222/144.5, 145.5
See application file for complete search history.

(56) References Cited

U.S. PATENT DOCUMENTS 2,746,641 A * 5/1956 King ..... 222/2
2,934,243 A * 4/1960 Metzger ..... 222/145.7
3,349,968 A * 10/1967 Yuza ..... 222/132
3,396,871 A * 8/1968 Mccann ..... 141/362
3,727,844 A * 4/1973 Bencic ..... 239/414
4,218,014 A * 8/1980 Tracy ..... 239/106
4,266,726 A * 5/1981 Brown et al. ..... 239/406
4,535,917 A * 8/1985 Trewhella ..... 222/129.1
4,651,862 A * 3/1987 Greenfield, Jr. ..... 194/344
4,676,401 A * 6/1987 Fox et al. ..... 222/1
4,708,266 A * 11/1987 Rudick ..... 222/105
4,932,564 A * 6/1990 Austin et al. ..... 222/129.1
4,960,228 A * 10/1990 Takahashi et al. ..... 222/129.1
4,966,306 A * 10/1990 Credle et al. ..... 222/1
5,033,648 A * 7/1991 Nakayama et al. ..... 222/129.1
5,607,083 A * 3/1997 Vogel et al. ..... 222/129.1
5,881,917 A * 3/1999 Jones et al. ..... 222/129
6,056,208 A * 5/2000 Pirker et al. ..... 239/119
6,390,662 B1 * 5/2002 Henry et al. ..... 366/177.1
6,450,369 B1 * 9/2002 Heyes ..... 222/129.1

* cited by examiner

*Primary Examiner*—Frederick C. Nicolas
(74) *Attorney, Agent, or Firm*—Pyle & Piontek, LLC

(57) ABSTRACT

A beverage dispense system has a dispense nozzle with inlet sections for connection to beverage supplies that merge into an outlet section sized to match the flows such that a unit volume of beverage can be dispensed more quickly. The inlet sections are provided with separate valves controlling the flow so that beverage can be dispensed through either one or both inlet sections. The nozzle is automatically drained on completion of a dispense by air admitted to the nozzle via a passageway.

10 Claims, 10 Drawing Sheets

BEVERAGE DISPENSE

FIELD OF THE INVENTION

This invention concerns improvements in or relating to beverage dispense and has particular, but not exclusive, application to the dispense of beverages such as beer or lager.

More especially, the invention concerns an improved dispense head for beverages and an apparatus and method for dispensing beverages employing the dispense head.

BACKGROUND OF THE INVENTION

It is well known to pump beer/lager from a keg located in a cellar room to a remote dispense head positioned at a bar counter for dispense of beer/lager. Typically, the beer/lager is chilled in the cellar and is delivered to the dispense head in a supply line commonly referred to as a "python".

The beer/lager may be cooled to its dispense temperature by a cooler in the cellar and prevented from warming appreciably between the cellar and the dispense head by circulating cooling fluid, usually water, in the python.

For some applications, the beverage may be cooled to within a few degrees of the dispense temperature and a further cooler, sometimes referred to as a "trim" or "flash" cooler, provided close to the dispense head to provide accurate control of the dispense temperature.

This cooler provides final adjustment of the dispense temperature immediately prior to dispense and may allow beer/lager to be dispensed at very cold temperatures, e.g. down to and below 0° C. without freezing in the supply line.

Known dispense heads commonly include a valve that controls dispense of the beer/lager. The valve is operable by any suitable means and careful control is required to prevent breakout of $CO_2$ occurring as the beer/lager is dispensed leading to frothing in the dispense head and in the glass into which the beer/lager is being dispensed. Existing dispense heads are generally capable of dispensing a full pint of beer/lager without excessive breakout in about 14-20 seconds.

On completion of a dispense, some beer/lager remains in the nozzle downstream of the dispense valve when the valve is closed. This may lead to incomplete dispense of the desired volume of the beverage, for example half-pint or pint measures.

In addition, the beer/lager remaining in the nozzle may warm up before the next dispense and this may have an adverse affect on the temperature, taste of the next dispense.

These problems may be increased by growth of bacteria, where the beer/lager remains in the nozzle for a prolonged period of time between dispenses, for example overnight.

SUMMARY

The present invention has been made from a consideration of the foregoing problems and disadvantages.

It is a desired aim of the present invention to provide a dispense head capable of dispensing a given volume of beverage faster than existing dispense heads.

It is another desired aim of the present invention to provide a dispense head capable of dispensing at least two beverages separately or as a mixture.

It is yet another desired aim of the present invention to provide a dispense head capable of dispensing at least two beverages at the same or different temperatures.

It is a still further desired aim of the present invention to provide a dispense head in which a dispense nozzle is capable of draining beverage therefrom on completion of a dispense.

These and other aims and advantages of the invention will be apparent from the description hereinafter of exemplary embodiments.

According to one aspect of the present invention, there is provided a dispense head comprising a plurality of inlets for connection to separate beverage supply lines, each inlet communicating with a dispense valve opening to a common dispense nozzle.

By this invention, the dispense head can dispense beverage from a plurality of supply lines simultaneously by combining the flows for discharge through one dispense nozzle.

In this way, the volume of beverage dispensed in unit time can be increased leading to faster dispense of a given volume of beverage compared to existing dispense heads.

Furthermore, such faster dispense may be obtained without adverse affect on the beverage, i.e. without increased $CO_2$ breakout leading to frothing in the dispense head.

As a result, improved efficiency and greater profitability may be achieved.

Two or more inlets may communicate with a common dispense valve controlling the beverage supply lines connected to those inlets. In this way, the dispense head can dispense beverage simultaneously from all the inlets connected to the common dispense valve. Additional inlets may be arranged to communicate with the same dispense valve or with a separate dispense valve.

More preferably, each inlet communicates with a separate dispense valve controlling the beverage supply line connected to that inlet. In this way, the dispense head may be operable to dispense beverage from each supply line individually or in combination with one or more other supply lines.

In one arrangement, the inlets are connected to supplies of the same beverage, for example beer/lager. The supplies may be at the same temperature or different temperatures. In this way, the speed of dispense and/or the temperature of the dispensed beverage may be varied.

In another arrangement, the inlets are connected to supplies of different beverages, for example beer/lager and lemonade. In this way, each beverage may be dispensed separately or a mixture of both beverages may be dispensed. The relative proportions of each beverage in the dispensed beverage may be varied. The beverages may be at the same temperature or different temperatures.

The flow of beverage in each supply line may be metered during dispense and the associated dispense valve closed when the required volume of beverage has been dispensed. In this way, the relative proportions of each beverage supply in the dispensed beverage can be varied.

A lower flow may be provided at the start of the dispense and/or at the end of the dispense by opening/closing the dispense valves at different times during the dispense. In this way, a profiled dispense may be obtained so that $CO_2$ breakout at the start of the dispense and spillage at the end of the dispense may be reduced or avoided.

The dispense nozzle preferably has at least two inlet sections for receiving beverage from the dispense valves and the inlet sections merge into an outlet section having a cross-sectional area matching the combined cross-sectional areas of the inlet sections.

In this way, the nozzle can accommodate the combined flows of the beverage supplies when both dispense valves are open. By matching flow through the outlet section with the inlet sections, the risk of $CO_2$ breakout occurring during dispense is reduced.

Preferably, the inlet sections are inclined relative to the outlet section and converge to merge smoothly into the outlet section avoiding sudden changes in the direction of flow. This contributes further to reducing $CO_2$ breakout during dispense.

Advantageously, the dispense valves are on/off solenoid valves providing fast switching between open and closed conditions for controlling dispense of the associated beverage supply. In this way, undesirable jetting of beverage on opening and closing the valves causing fobbing and breakout of $CO_2$ is controlled.

Preferably, the dispense valves are operable via a control unit in response to user actuation of a dispense. The control unit may include a programmable microprocessor and memory element for user selection of different dispenses. For example, the control unit may permit dispense of different volumes of beverage such as a pint or half-pint made up of either one or both beverage supplies. The control unit may be operable via a user interface such as a control panel or keypad or a suitable link to such interface.

Advantageously, means is provided for draining the dispense nozzle downstream of the dispense valve when the dispense valve is closed. In this way, the dispense nozzle is drained at the end of each dispense so that beverage is not retained in the nozzle which can adversely affect the quality of the next dispense of beverage.

Preferably, the means for draining the dispense nozzle comprises an airway for admitting air to the dispense nozzle at the end of the dispense.

In one arrangement, the airway comprises an unrestricted passageway open to atmosphere and air is prevented from being drawn into the nozzle during dispense by the positive pressure of the beverage being dispensed.

More specifically, the passageway may be sized so that a small proportion of the dispensed beverage flows out through the airway to prevent air being drawn into the main beverage stream through the nozzle. The beverage which flows out of the passageway may pass down the outside of the nozzle and re-combine with the main beverage stream emerging from the nozzle.

When the dispense valve is closed at the end of the dispense, the flow of the beverage creates a vacuum in the dispense nozzle downstream of the dispense valve that causes air to be drawn into the nozzle through the airway allowing the nozzle to drain fully.

In this way, the nozzle is drained at the end of the dispense without causing a noticeable interruption in the flow. As a result, the draining of the nozzle does not lead to significant increase in the overall dispense time The airway is preferably arranged at an acute angle to the direction of flow of beverage through the nozzle to assist in preventing air being drawn into the nozzle by the venturi effect during beverage dispense.

In another arrangement, the airway comprises a passageway controlled by a drain valve that is closed to prevent air being drawn into the nozzle during beverage dispense. When the dispense valve is closed at the end of the dispense, the drain valve is opened allowing air to be drawn into the nozzle by the vacuum created by the flow of the beverage and allowing the nozzle to drain fully.

The drain valve may be electrically operable, for example an on/off solenoid valve. Alternatively, the drain valve may be operable mechanically. The drain valve may be opened automatically in response to closing of the dispense valve.

A short time delay may be provided between the dispense valve closing and the drain valve opening to ensure air is not admitted to the nozzle while the dispense valve is open as this could give rise to undesirable fobbing within the dispense head. Alternatively, the drain valve may be opened manually after the dispense valve has closed.

Where two dispense valves communicate with respective inlet sections of the dispense nozzle that merge into a common outlet section, the inlet sections may have separate airways for draining the nozzle at the end of the dispense. Alternatively, a common airway may be provided, for example where the inlet sections merge into the outlet section, for draining the nozzle at the end of the dispense.

According to another aspect of the invention, there is provided beverage dispense apparatus including at least two supply lines connected to a source of beverage, a dispense head connected to each supply line and having a dispense valve for controlling flow of beverage from each supply line through the dispense head, and a dispense nozzle for combining flows from the supply lines whereby each supply can be dispensed separately or in combination with at least one other supply.

The supply lines may be connected to a common source of beverage or to separate sources of different beverages.

According to a further aspect of the present invention, there is provided a method of dispensing a beverage comprising providing at least two beverage supplies to a dispense head, and controlling the flow of each supply through the dispense head for dispensing each supply separately or in combination with at least one other supply.

The beverage supplies may be the same beverage or different beverages.

According to another aspect of the present invention, there is provided a dispense nozzle for dispensing a beverage, the dispense nozzle comprising at least two inlet sections for connection to respective beverage supplies, and an outlet section for dispensing beverage flowing through each inlet section under the control of a dispense valve.

Preferably, the outlet section is sized to match the combined flow through the inlet sections. In this way, the dispense head can dispense beverage from a plurality of beverage supplies simultaneously by combining the flows through the inlet sections connected to the supplies for discharge through the outlet section of the dispense nozzle.

Advantageously, the inlet sections are connected to the associated supplies via separate dispense valves. In this way, the supplies can be dispensed separately or in combination with another supply by controlling opening/closing of the dispense valves.

According to a still further aspect of the present invention, there is provided a dispense head comprising an inlet for connection to a beverage supply line, the inlet communicating with a dispense valve opening to a dispense nozzle, and means for draining the dispense nozzle downstream of the dispense valve when the dispense valve is closed.

The drain means may comprise an inlet for admitting air to drain the dispense nozzle on completion of a dispense.

According to another aspect of the invention, there is provided a method of dispensing a beverage comprising providing a dispense head having a dispense valve and a dispense nozzle wherein the nozzle is vented to atmosphere at the end of a dispense to drain any beverage from the nozzle downstream of the dispense valve.

The nozzle may be vented by an airway through which air can be admitted when the dispense valve is closed. The airway may be unrestricted allowing liquid to escape during dispense and preventing admission of air to the nozzle. Alternatively, the airway may be controlled by a drain valve.

According to yet another aspect of the invention, there is provided a dispense nozzle for dispensing a beverage, the nozzle comprising a passageway for flow of beverage to be dispensed through the nozzle, the passageway having a beverage inlet and a beverage outlet, and means for admitting air to the passageway.

The air admitting means may comprise an airway connecting the passageway to atmosphere. The airway may be unrestricted or a valve may be provided to open and close the airway.

The invention will now be described in more detail, by way of example only, with reference to the accompanying drawings, wherein.

DETAILED DESCRIPTION OF THE EXEMPLARY EMBODIMENTS

Figure 1:
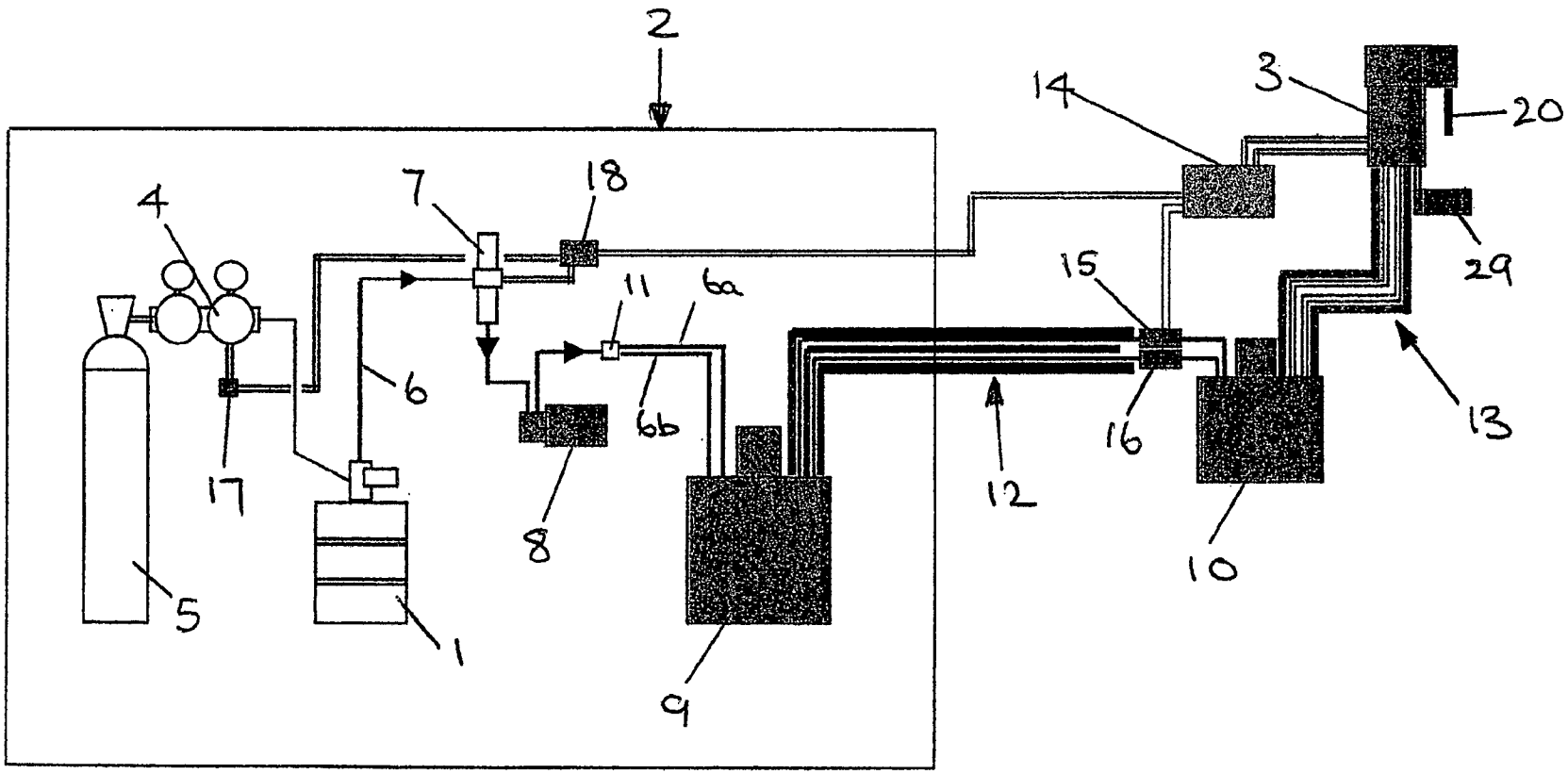
FIG. 1 is a schematic lay-out of a beverage dispense system with a dispense head according to a first embodiment of the present invention.

Referring first to FIG. 1 of the accompanying drawings, there is shown a dispense system for beer/lager comprising a keg 1 or similar bulk storage container located in a cellar 2 for supply of beer/lager to a remote dispense head 3 positioned at a bar counter (not shown).

The keg 1 is connected via a pressure regulator 4 to a source 5 of $CO_2$ under pressure to maintain a desired level of $CO_2$ in the beer/lager. It will be understood that the regulator 4 is sized to match the flow requirements of the system to prevent the regulator 4 freezing during periods of high flow. It will also be understood that any other suitable gas or gas mixture, for example a mixture of $CO_2$ and $N_2$, may be used in place of $CO_2$.

Beer/lager is pumped from the keg 1 to the dispense head 3 in a supply line 6 including a fob monitor 7, beer pump 8, primary cooler 9 and secondary cooler 10.

Between the beer pump 8 and primary cooler 9, the supply line 6 is split into two lines 6*a*, 6*b* at a manifold 11. Both lines 6*a*, 6*b* pass through the primary cooler 9 within the cellar 2 to cool the beer/lager to within a few degrees of the desired dispense temperature.

From the cellar 2, both lines 6*a*, 6*b* pass in a python 12 to the secondary cooler 10. The secondary cooler 10 is located close to the dispense head 3, for example under the bar counter, to cool the beer/lager to the desired dispense temperature. From the secondary cooler 10, the lines 6*a*, 6*b* pass in a python 13 to the dispense head 3.

The primary and secondary coolers 9 and 10 may be of any suitable type and in this embodiment are ice bank coolers having a reservoir of cold water that is re-circulated in the pythons 12 and 13 respectively to prevent the beer/lager leaving the coolers 9 and 10 warming up to any appreciable extent.

The supply lines 6*a*, 6*b* are connected to the dispense head 3 and the dispense of beer/lager is controlled via a control unit 14 in response to user actuation of a dispense, for example via a switch.

The control unit 14 is arranged to receive data from a pair of flow metering turbines 15 and 16 arranged in the supply lines 6*a*, 6*b*. The control unit 14 is also connected to the fob monitor 7 and to a $CO_2$ pressure switch 17 via a control unit 18 in the cellar 2.

Referring now to FIGS. 2 to 5 of the drawings, the dispense head 3 has separate inlets 19*a*, 19*b* connected to the supply lines 6*a*, 6*b* and a dispense nozzle 20 in fluid communication with the inlets 19*a*, 19*b* via on/off solenoid valves 21*a* (one only shown).

Figure 2:
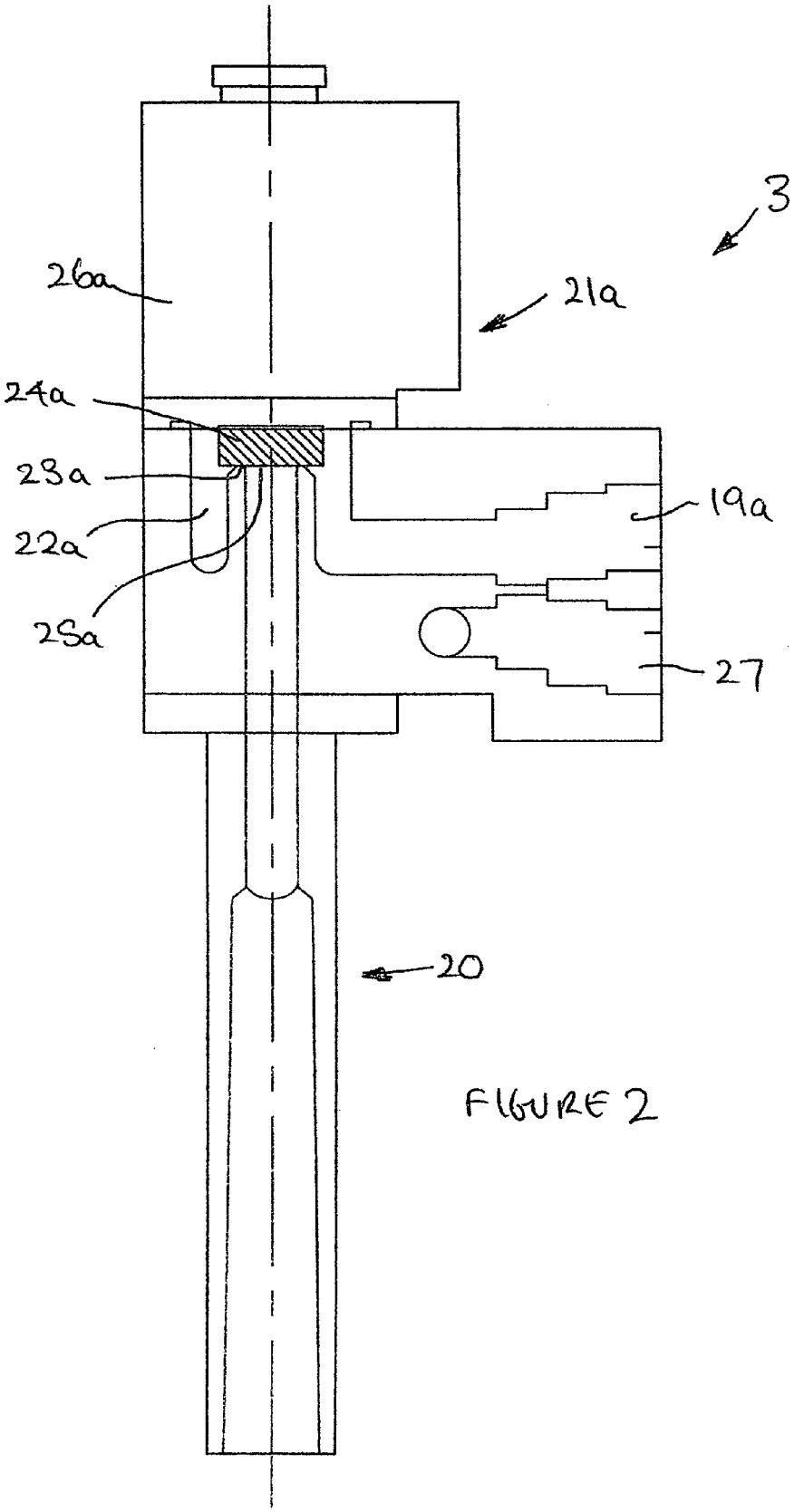
FIG. 2 is a side view, to an enlarged scale and partly in section, of the dispense head shown in FIG. 1.
Figure 3:
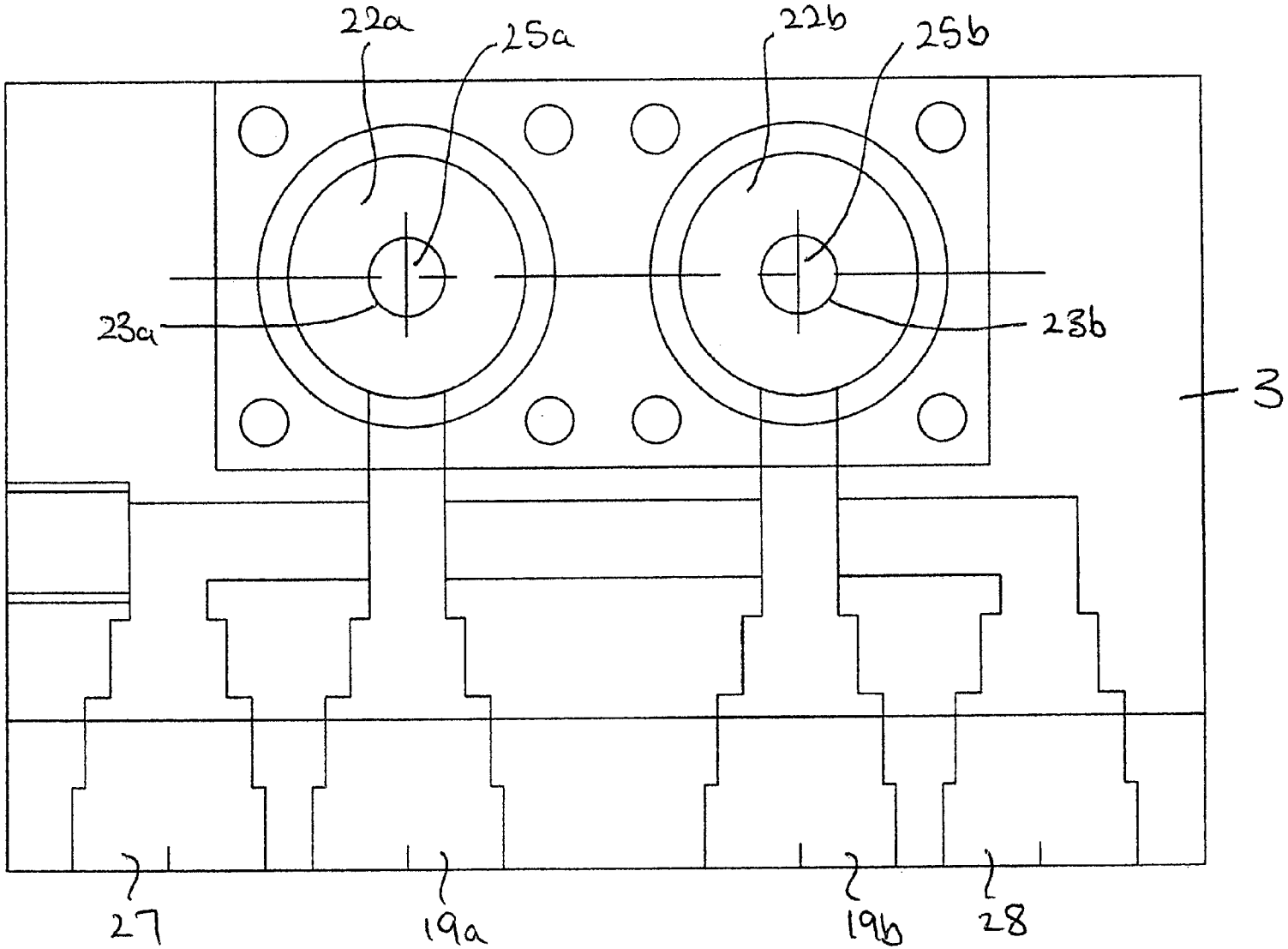
FIG. 3 is a plan view of the dispense head shown in FIG. 2 with the solenoid heads removed.

As best shown in FIGS. 2 and 3, each inlet 19*a*, 19*b* opens to an annular valve chamber 22*a*, 22*b* surrounding an annular valve seat 23*a*, 23*b* of the associated solenoid valve 21*a*. Each valve chamber 22*a*, 22*b* contains a valve member 24*a* (one only shown) engageable with the valve seat 23*a*, 23*b* to close a port 25*a*, 25*b* opening to the dispense nozzle 20.

Each valve member 24*a* is movable away from the valve seat 23*a*, 23*b* to open the port 25*a*, 25*b* in response to energisation of a solenoid 26*a* (one only shown) and is movable towards the valve seat 23*a*, 23*b* to close the port 25*a*, 25*b* under the biasing of a restoring force when the solenoid 26*a* is de-energised.

In this embodiment, the energising voltage initially applied to the solenoids 26*a* is chosen to provide fast switching of the valves 21*a* to the fully open condition to control undesirable jetting of the beer/lager causing fobbing and $CO_2$ breakout in the dispense head 3.

After initial opening, the solenoid valves 21*a* are held open by applying a reduced voltage to the solenoids 26*a* to minimise heat generated during the dispense cycle. In this way, heat build-up causing undesirable warming of the beer/lager in the dispense head 3 is reduced, especially during periods of high use.

The dispense head 3 has an inlet 27 and an outlet 28 for re-circulating cooling water in the python 13 through the dispense head 3. In this way, the beer/lager is maintained at the desired dispense temperature and is prevented from warming up to any appreciable extent in the dispense head 3, especially during periods of non-dispense.

In a modification (not shown), where one or both beverage supplies is dispensed at temperatures at or below 0° C., the inlet 27 and outlet 28 may be arranged to circulate warm water through the dispense head 3 to prevent the beverage freezing in the dispense head 3 between dispenses.

Figure 4:
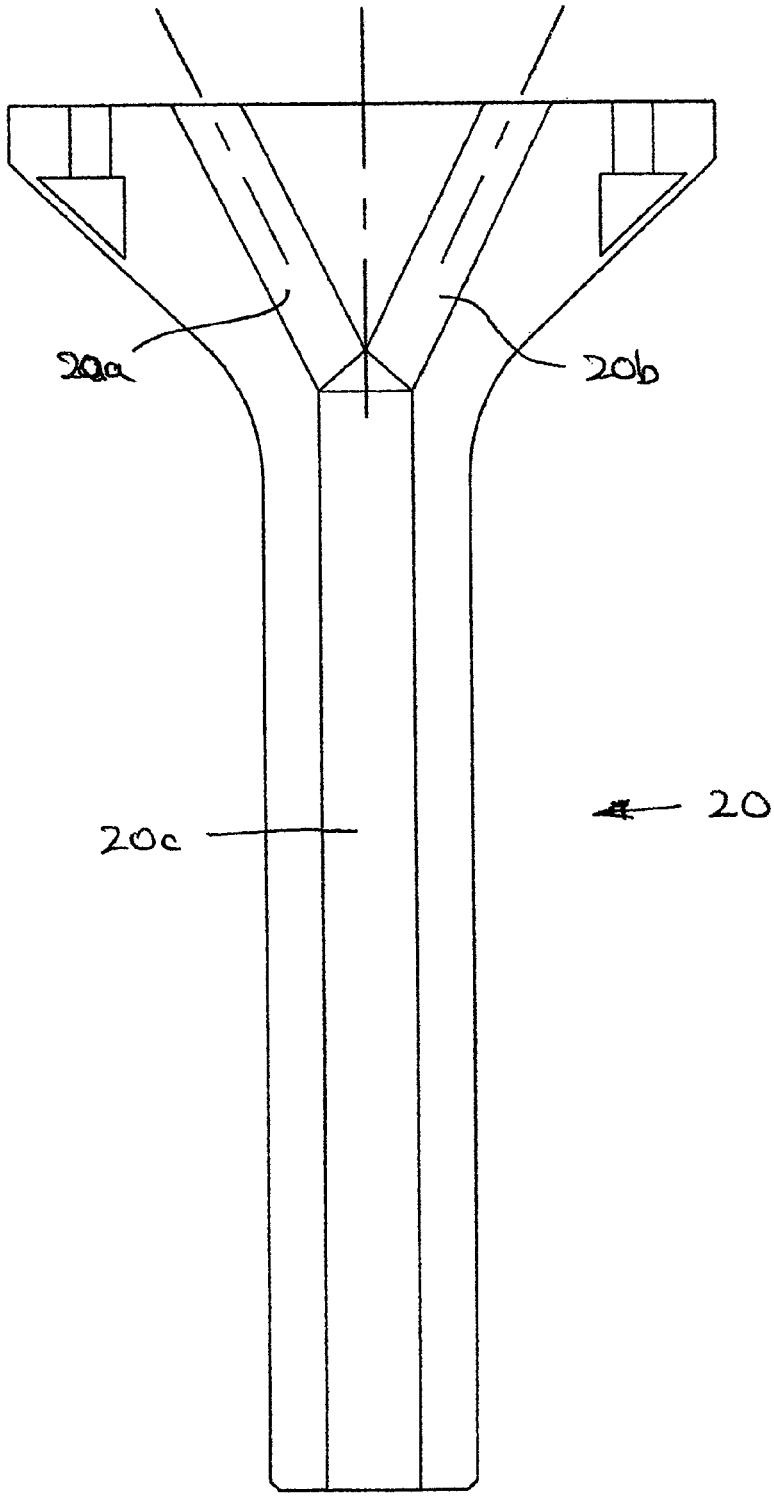
FIG. 4 is a longitudinal sectional view, to an enlarged scale, of the nozzle of the dispense head shown in FIGS. 1 to 3.
Figure 5:
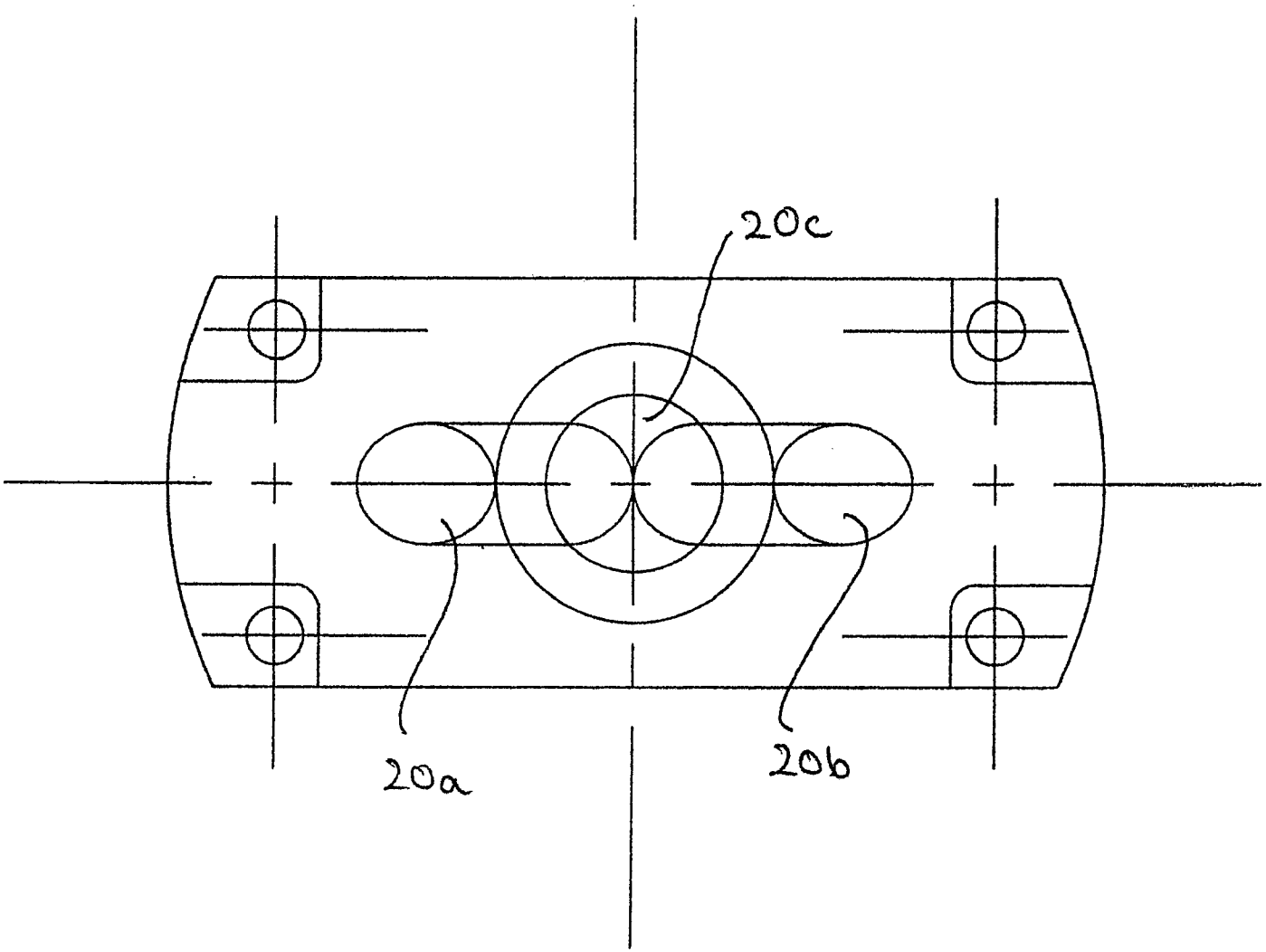
FIG. 5 is a plan view of the nozzle shown in FIG. 4.

As best shown in FIGS. 4 and 5, the nozzle 20 has inlet sections 20*a*, 20*b* connected to the solenoid valves 21*a*, 21*b*. The inlet sections 20*a*, 20*b* merge into a common outlet section 20*c*. The outlet section 20*c* is of increased cross-section to match the combined cross-sections of the inlet sections 20*a*, 20*b*.

In this way, when both solenoid valves 21*a* are open, the nozzle 20 can dispense the total flow to the dispense head 3 in both supply lines 6*a*, 6*b* into a glass (not shown) positioned below the nozzle 20 on a drip tray 29 (FIG. 1).

As shown, each inlet section 20*a*, 20*b* is straight and of uniform cross-section throughout its length. The outlet section 20*c* is also straight and of uniform cross-section or slightly increasing cross-section in the direction of flow.

The inlet sections 20*a*, 20*b* are inclined relative to the outlet section 20*c* and converge to merge smoothly into the outlet section 20*c*. In this way, changes in the direction of flow through the dispense nozzle 20 are kept to a minimum and the risk of $CO_2$ breakout within the nozzle 20 during dispense is reduced.

In use, the solenoid valves 21*a* are opened in response to user actuation of a dispense. The valves 21*a* may be opened at the same time or one valve 21*a* may be opened ahead of the other to provide a lower initial flow.

The flow of beer/lager in each supply line 6*a*, 6*b* is measured by the flow metering turbines 15, 16 and the control unit 14 is operable to close the valves 21*a* when the required volume of beer/lager has been dispensed.

The valves 21*a* may be closed at the same time or one valve 21*a* may be closed ahead of the other to provide a lower final flow.

By providing the dispense head 3 with two inlets 19*a*, 19*b* for connection to separate supply lines 6*a*, 6*b* and combining the flows for dispense from a single nozzle 20, the flow through the dispense head 3 can be increased significantly.

This can be achieved without any modification to the size of the supply lines 6*a*, 6*b*. Thus, the dispense head 3 can be connected to any two beverage supply lines of an existing python system for delivery of beverage from a remote location to the dispense head 3.

As will be appreciated, the arrangement of twin inlets 19*a*, 19*b* and solenoid valves 21*a* controlling the flow provides flexibility for dispensing from either one or both of the supply lines 6*a*, 6*b* connected to the dispense head 3.

Furthermore, where dispense is from both supply lines 6*a*, 6*b*, the time taken to dispense a given volume of beverage is reduced significantly compared to dispense of the same volume from one supply line. For example, dispense of a full pint of beer/lager can be achieved in approximately 5 seconds without significant break-out of $CO_2$ occurring within the dispense head 3.

The control unit 14 may be operable to open both solenoid valves 21*a* simultaneously and to close both valves 21*a* simultaneously when the required total flow for a selected dispense has been measured.

Alternatively, the control unit 14 may stagger the opening and/or closing of the valves 21*a* to provide a profiled dispense. For example, flow may be reduced at the start and/or end of a dispense by opening and closing the valves 21*a* at different times during the dispense cycle.

In this way, more accurate control of the dispense can be achieved. In particular, $CO_2$ break-out causing excessive frothing in the dispense head 3 and/or the glass at the start of the dispense may be reduced and/or the risk of spillage at the end of dispense may also be reduced.

In the above-described embodiment, the same beer/lager is delivered to the dispense head 3 in the supply lines 6*a*, 6*b* at the same dispense temperature. It will be appreciated, however, that the beer/lager could be cooled to different temperatures in each supply line 6*a*, 6*b*.

For example, one of the supply lines 6*a*, 6*b* may be arranged to by-pass the secondary cooler 10 so that the temperature of the beer/lager delivered to the dispense head 3 is higher than that of the beer/lager in the other supply line.

In this way, the dispense head 3 could be operable to dispense beer/lager from either one or both of the supply lines 6*a*, 6*b* to dispense the same beer/lager at different temperatures.

For example, by opening either one of the dispense valves 21*a* beer/lager is dispensed at a higher or lower temperature. Alternatively, by opening both dispense valves 21*a* beer/lager is dispensed at an intermediate temperature according to the relative proportions of the two flows dispensed.

It will also be appreciated that the supply lines 6*a*, 6*b* could be connected to sources of two different beverages. For example, one supply line 6*a* may be connected to a source of beer/lager and the other supply line 6*b* to a source of lemonade.

In this way, the dispense head 3 may be operable to dispense beer/lager only or lemonade only by opening the appropriate dispense valve 21*a* or a mixture of both by opening both dispense valves 21*a*.

The relative proportions of each beverage in the mixture may be varied by controlling each dispense valve 21*a* to adjust the metered volume of each beverage dispensed. Each beverage may be at the same temperature or at different temperatures.

The control unit 14 may include a programmable microprocessor and memory element for controlling each dispense in accordance with user selection via an interface such as a control panel or keypad on or adjacent to the dispense head 3.

As will now be appreciated, the provision of separate beverage supply lines and dispense valves for dispensing the supplies via a common dispense nozzle provides flexibility for dispensing the supplies separately or in combination.

In this way, a unit volume of beverage may be dispensed more quickly by combining flows from separate beverage lines. In addition, mixtures of different beverage supplies can be dispensed in varying proportions.

Figure 6:
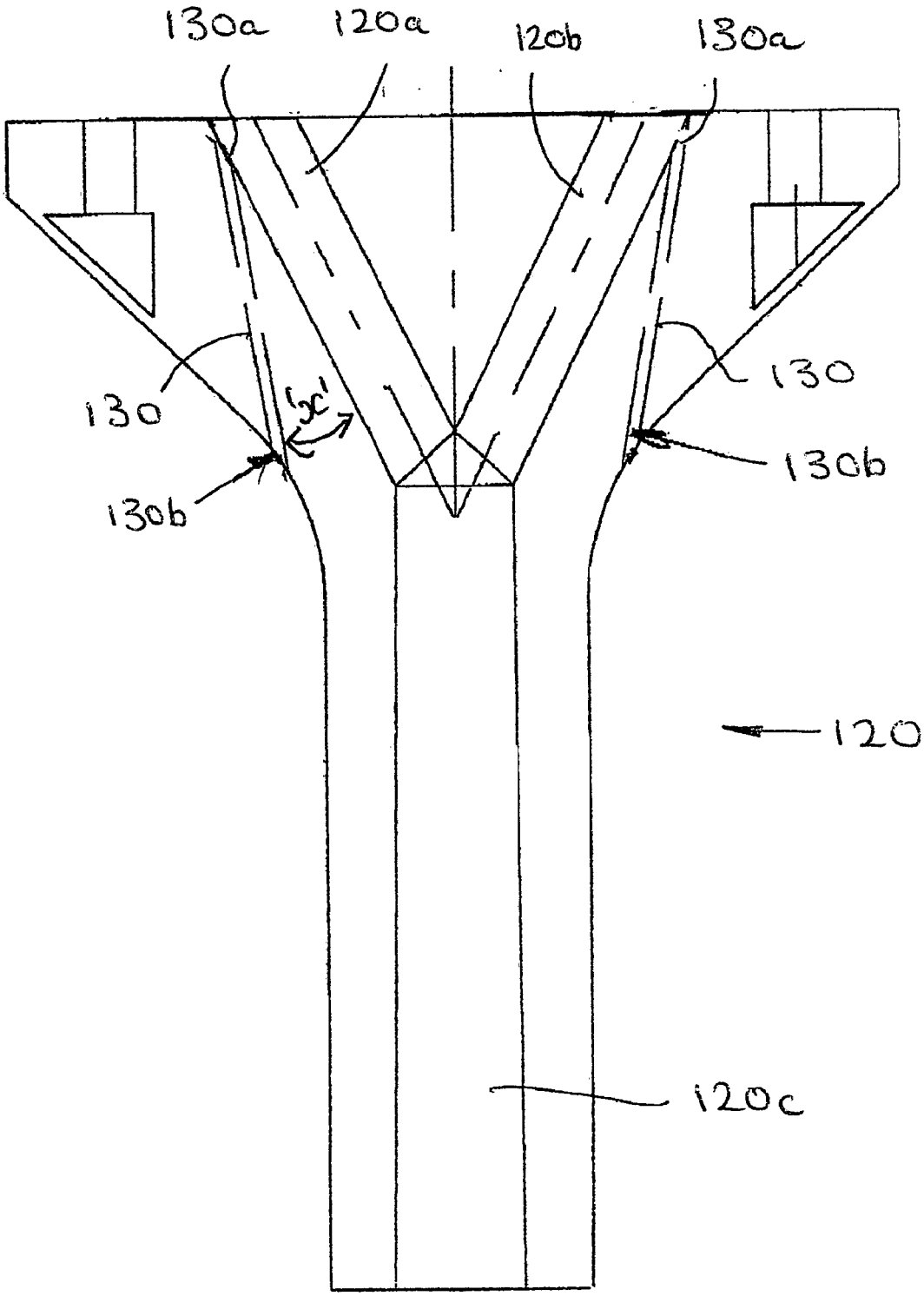
FIG. 6 is a longitudinal section showing a modification to the dispense nozzle shown in FIGS. 4 and 5 according to another aspect of the present invention.
Figure 7:
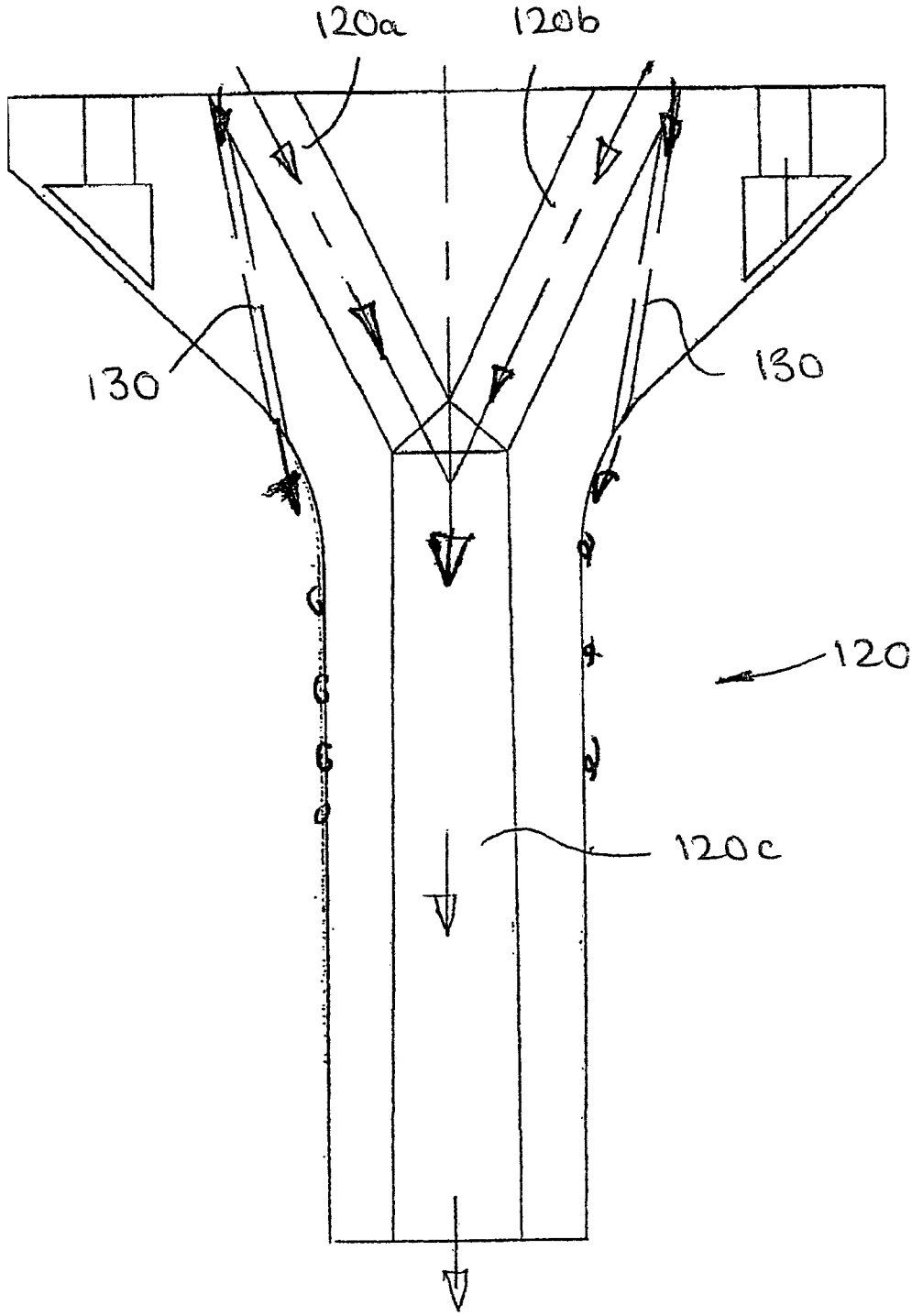
FIG. 7 is a longitudinal section similar to FIG. 6 showing the liquid flow during dispense.
Figure 8:
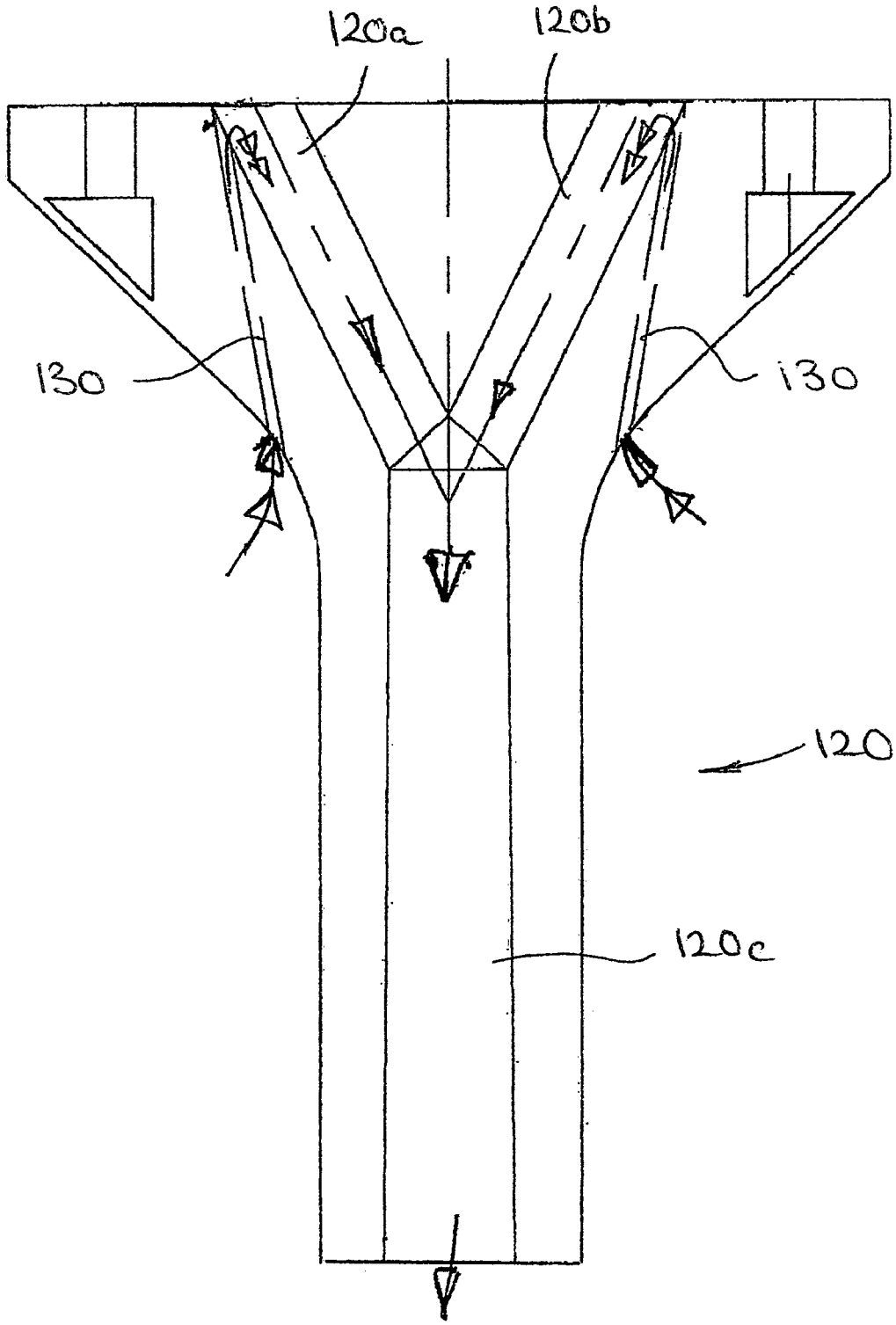
FIG. 8 is a longitudinal section similar to FIG. 6 showing the air flow on completion of dispense.
Figure 9:
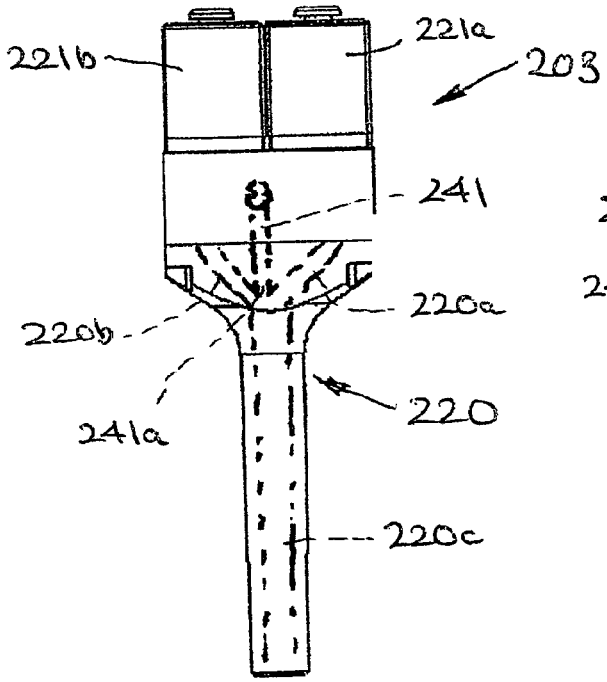
FIG. 9 is a front view of a dispense head according to a second embodiment of the present invention.
Figure 10:
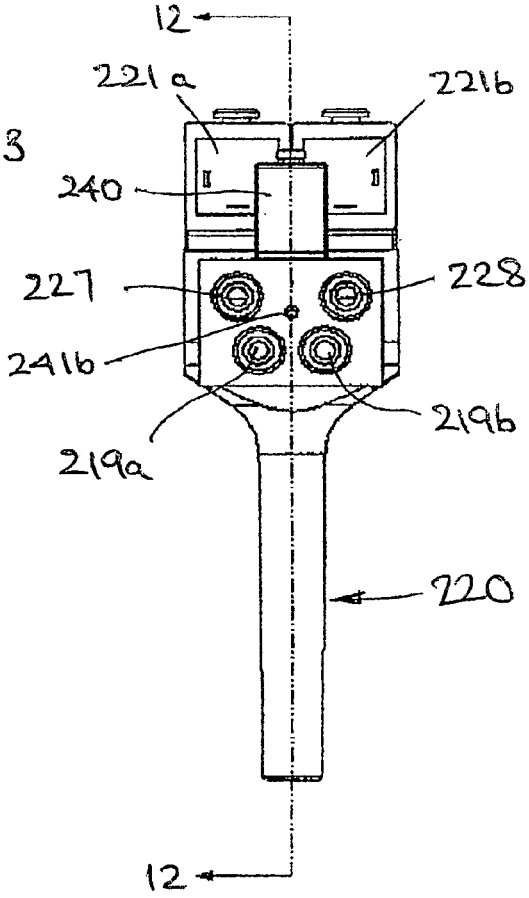
FIG. 10 is a rear view of the dispense head shown in FIG. 9.
Figure 11:
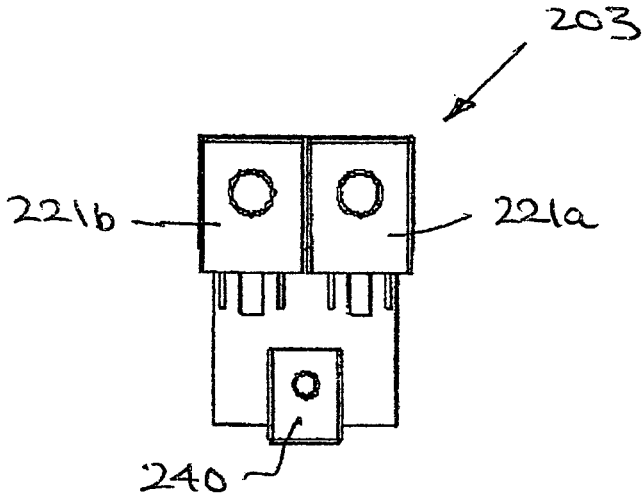
FIG. 11 is a plan view of the dispense head shown in FIG. 9.
Figure 12:
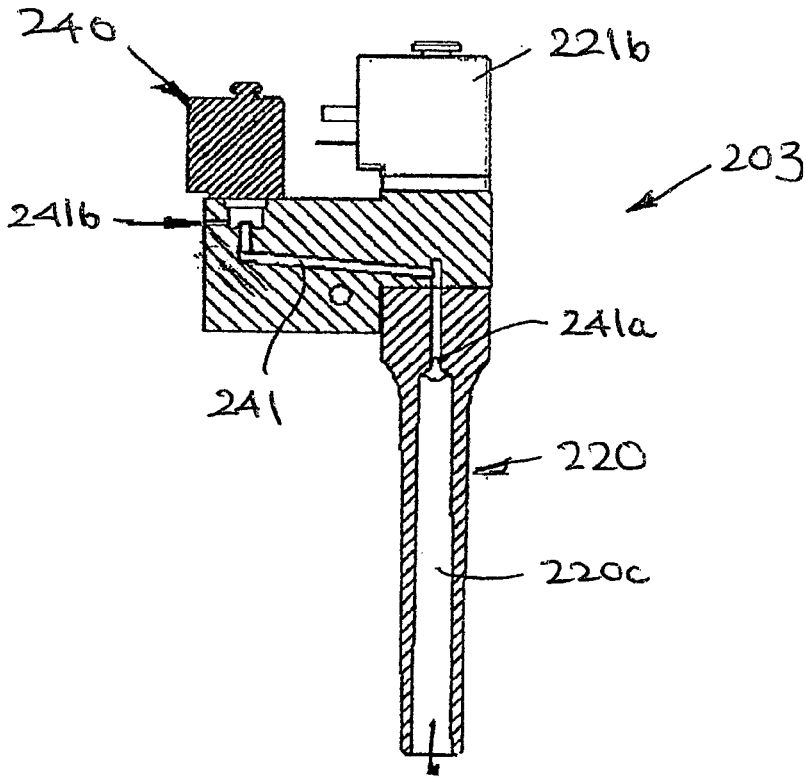
FIG. 12 is a section on the line 12-12 of FIG. 10.

Referring now to FIGS. 6 to 8 of the accompanying drawings, there is shown a modification to the dispense nozzle of the previous embodiment for draining the dispense nozzle at the end of each dispense. For convenience, like reference numerals in the series 100 are used to indicate parts corresponding to the previous embodiment.

In this embodiment, the dispense nozzle 120 has two inlet sections 120*a*,120*b* for connection to a beverage supply via respective on/off solenoid valves (not shown). The inlet sections 120*a*,120*b* may be connected to supplies of the same beverage or different beverages at the same or different temperatures.

The inlet sections 120*a*,120*b* merge into a common outlet section 120*c*. The outlet section 120*c* is of increased cross-section to match the combined cross-sections of the inlet sections 120*a*,120*b*.

In this way, when both solenoid valves are open, the outlet section 120*c* can dispense the total flow in both inlet sections 120*a*, 120*b* into a glass (not shown) positioned below the nozzle 120.

As shown, each inlet section 120*a*,120*b* is straight and of uniform cross-section throughout its length. The outlet section 120*c* is also straight and of uniform cross-section or slightly increasing cross-section in the direction of flow.

The inlet sections 120*a*,120*b* are inclined relative to the outlet section 120*c* and converge to merge smoothly into the outlet section 120*c*. In this way, changes in the direction of flow through the dispense nozzle 120 are kept to a minimum and the risk of $CO_2$ breakout within the nozzle 120 during dispense is reduced.

Each inlet section 120*a*,120*b* communicates with atmosphere via a respective passageway 130 for admitting air to the dispense nozzle 120. One end 130*a* of each passageway 130 opens into the associated inlet section 120*a*,120*b* adjacent to the downstream side of the on/off solenoid valve and the other end 130*b* is open to atmosphere. Each passageway 130 extends at an acute angle "x" to the direction of beverage flow in the associated inlet section 120*a*,120*b*.

In use, the on/off solenoid valves are opened in response to user actuation of a dispense allowing beverage to flow through inlet sections 120*a*,120*b* of the nozzle 120 into the outlet section 120*c* and emerge from the nozzle 120. At the same time, air is prevented from being drawn into the beverage flow in the inlet sections 120*a*,120*b* via the passageways 130 by the positive pressure of the beverage which causes beverage to flow out of the nozzle 120 via the passageways 130 and to pass down the outside of the nozzle 120 to merge with the main beverage stream emerging from the nozzle 120. The flow of beverage is indicated in FIG. 7 by single headed arrows.

The passageways 130 have a small cross-sectional area compared to the inlet and outlet sections 120*a*,120*b*,120*c* of the nozzle 120 so that the volume of beverage passing through the passageways 130 is negligible compared to the volume of the main stream flowing through the nozzle 120 but is sufficient to prevent air being drawn into the nozzle 120 when the solenoid valves are open. In addition, the arrangement of the passageways 130 at an acute angle to beverage flow in the inlet sections 120*a*,120*b* further assists in preventing air being drawn into the nozzle by venturi effect.

On completion of the dispense, the solenoid valves are closed to shut-off the flow of beverage to the nozzle 120. As a result, the flow of beverage downstream of the solenoid valves creates a vacuum in the nozzle 120 that causes air to be drawn into the inlet sections 120*a*,120*b* of the nozzle 120 via passageways 130 and allows the nozzle 120 to drain fully without interruption of flow. The flow of air is indicated in FIG. 8 by double headed arrows and the flow of beverage by single headed arrows.

In this way, beverage is not retained in the dispense nozzle 120 downstream of the solenoid valves between dispenses. Moreover, because the air is admitted in a controlled manner at the end of the dispense, it does not give rise to any significant fobbing within the dispense nozzle 120.

As will be appreciated, the dispense nozzle 120 is automatically drained at the end of each dispense. As a result, substantially full dispense of a measured volume of beverage can be achieved. Also, no beverage remains in the nozzle 120 which can warm-up between dispenses and/or degrade. In this way the potential adverse effect on the next dispense of beverage that has warmed-up and/or degraded in the nozzle 120 is significantly reduced.

Referring now to FIGS. 9 to 12 of the accompanying drawings, there is shown a second embodiment of a dispense head for dispensing beverages such as beer/lager according to the present invention. For convenience, like reference numerals in the series 200 are used to indicate parts corresponding to the previous embodiments.

In this embodiment, the dispense head 203 has separate inlets 219*a*, 219*b* connectable to supply lines (not shown) for the same or different beverages and a dispense nozzle 220 in fluid communication with the inlets 219*a*, 219*b* via dispense valves 221*a*, 221*b* respectively.

In this embodiment, the dispense valves 221*a*, 221*b* are electrically operable on/off solenoid valves that are switched between open and closed conditions to control dispense of a measured volume of beverage via control means (not shown) in response to actuation of a beverage dispense.

The solenoid valves 221*a*, 221*b* provide fast switching to the fully open condition to control undesirable jetting of the beer/lager causing fobbing and $CO_2$ breakout in the dispense head 203. After initial opening, the solenoid valves 221*a*, 221*b* are held open by applying a reduced voltage to the solenoids to minimise heat generated during the dispense cycle. In this way, heat build-up causing undesirable warming of the beer/lager in the dispense head 203 is reduced, especially during periods of high use.

The dispense head 203 also has an inlet 227 and an outlet 228 for re-circulating cooling water through the dispense head 203. In this way, the beer/lager is maintained at the desired dispense temperature and is prevented from warming up to any appreciable extent in the dispense head 203 upstream of the solenoid valves 221*a*, 221*b* especially during periods of non-dispense.

In a modification (not shown), where one or both beverage supplies is dispensed at temperatures at or below 0° C., the inlet 227 and outlet 228 may be arranged to circulate warm water through the dispense head 203 to prevent the beverage freezing in the dispense head 203 between dispenses.

The solenoid valves 221*a*, 221*b* control flow of beverage to inlet sections 220*a*, 220*b* respectively of the dispense nozzle 220. The inlet sections 220*a*, 220*b* merge into a common outlet section 220*c*. The outlet section 220*c* is of increased cross-section to match the combined cross-sections of the inlet sections 220*a*,220*b*.

In this way, when both solenoid valves are open, the outlet section 220*c* can dispense the total flow in both inlet sections 220*a*, 220*b* into a glass (not shown) positioned below the nozzle 220.

As shown, each inlet section 220*a*,220*b* is straight and of uniform cross-section throughout its length. The outlet section 220*c* is also straight and of uniform cross-section or slightly increasing cross-section in the direction of flow.

The inlet sections 220*a*,220*b* are inclined relative to the outlet section 220*c* and converge to merge smoothly into the outlet section 220*c*. In this way, changes in the direction of flow through the dispense nozzle 220 are kept to a minimum and the risk of $CO_2$ breakout within the nozzle 220 during dispense is reduced.

The dispense head 203 further includes an on/off solenoid valve 240 controlling admission of air to the nozzle 220 via a passageway 241. One end 241*a* of the passageway 241 opens into the nozzle 220 where the inlet sections 220*a*, 220*b* merge and the other end 241*b* is open to atmosphere. In a modification (not shown), solenoid valve 240 may be replaced by any other suitable electrically or mechanically operable valve.

In use, solenoid valve 240 is closed and one or both of the solenoid valves 221*a*, 221*b* opened in response to user actuation of a dispense. In this way, a beverage dispense may comprise beverage from one supply line only or both supply lines.

By opening both solenoid valves 221*a*, 221*b* to dispense beverage from both supply lines, a faster dispense of a given volume of beverage, for example a half-pint or pint measure may be achieved. The valves 221*a*, 221*b* may be opened and closed at the same time.

Alternatively, the valves 221*a*, 221*b* may be opened and closed at different times to provide a profiled dispense, for example a lower flow at the start and end of the dispense. In this way, more accurate control of the dispense can be achieved.

Where the supply lines are connected to sources of different beverages, opening both solenoid valves 221*a*, 221*b* allows dispense of a mixture of beverages and dispense may be controlled to provide any desired ratio of each beverage in the dispensed beverage.

On completion of the dispense, the solenoid valves 221*a*, 221*b* are closed to shut-off the flow of beverage to the nozzle 220 and solenoid valve 240 is opened. As a result, the flow of beverage downstream of the valves 221*a*, 221*b* creates a vacuum in the nozzle 220 that causes air to be drawn into the nozzle 220 via passageway 241 and allows the nozzle 220 to drain fully without interruption of flow.

As will be appreciated, the dispense head 203 is operable to drain the dispense nozzle 220 at the end of each dispense. As a result, substantially full dispense of a measured volume of beverage can be achieved and beverage is not retained in the dispense head 203 downstream of the valves 221*a*, 221*b* between dispenses.

Additionally, because the air is admitted in a controlled manner at the end of the dispense, it does not give rise to any significant fobbing within the dispense head 203.

Furthermore, because draining occurs without interrupting the flow at the end of the dispense, dispense times are not significantly increased. This is of particular benefit where both valves 221*a*, 221*b* are opened for all or part of the dispense to provide a fast dispense.

Moreover, no beverage remains in the nozzle 220 which can warm-up between dispenses and/or degrade. In this way the potential adverse effect on the next dispense of beverage that has warmed-up and/or degraded in the nozzle 220 is significantly reduced.

The beverage dispense head in the above described embodiments is provided with separate beverage inlets connected to a common dispense nozzle via individual dispense valves such that each beverage supply may be dispensed separately or in combination with one or more other beverage supplies. It will be understood, however that other arrangements may be employed.

For example, at least two separate beverage inlets may communicate with a common dispense nozzle via a common dispense valve whereby the beverage supplies to the inlets are dispensed together. Additional inlets may communicate with the same dispense valve or with a separate dispense valve that opens to the same dispense nozzle. As will be appreciated various combinations of inlets and dispense valves may be employed.

The beverage dispense nozzle in some of the above described embodiments is provided with means for draining the nozzle on completion of a dispense in dispense heads in which separate beverage supplies communicate with respective inlet sections of the nozzle via individual dispense valves. It will be understood, however that other arrangements may be employed.

For example, a nozzle drain may be applied to dispense heads in which the flow of liquid through the dispense nozzle is controlled by a single dispense valve. The dispense valve may control beverage flow from one or more supplies and may be electrically operable such as a solenoid valve or mechanically operable.

Other modifications and improvements that can be made to the dispense head and dispense system will be apparent to those skilled in the art.

I claim:

1. A dispense head comprising a plurality of inlets for connection to separate beverage supply lines, each said inlet communicating with a respective one of a plurality of dispense valves and through its respective dispense valve with an associated one of a plurality of inlet sections that merge into a common outlet section leading to a common dispense nozzle, and including means for operating the dispense valves to provide a flow of beverage therethrough and from the dispense nozzle, such that a lower flow rate of beverage is provided from said dispense nozzle at one or both of the start of dispense of beverage and the end of dispense of beverage from said dispense nozzle by selectively opening and closing said dispense valves such that at one or both of the start of dispense of beverage and the end of dispense of beverage from said dispense nozzle at least one, but less than all, of said dispense valves are closed.

2. A dispense head according to claim 1, wherein said dispense valves are on/off solenoid valves.

3. A dispense head according to claim 1, wherein said dispense valves are operable via a control unit in response to user actuation of a dispense.

4. A dispense head according to claim 1, wherein said outlet section has a cross-sectional area matching the combined cross-sectional areas of said inlet sections.

5. A dispense head according to claim 1, wherein said inlet sections are inclined relative to said outlet section and converge to merge smoothly into said outlet section avoiding sudden changes in the direction of flow.

6. A dispense head comprising a plurality of inlets for connection to separate beverage supply lines, each inlet communicating with a dispense valve opening to a common dispense nozzle having a lower beverage outlet, wherein means is provided for draining the dispense nozzle downstream of the dispense valve when the dispense valve is closed, and wherein the drain means comprises an airway for admitting air to the dispense nozzle upstream from the outlet at the end of the dispense to drain beverage from the dispense nozzle through the lower outlet, wherein the airway comprises a passageway controlled by a drain valve that is closed to prevent air being drawn into the nozzle during beverage dispense.

7. A dispense head according to claim 6 wherein, when the dispense valve is closed at the end of the dispense, the drain valve is opened allowing air to be drawn into the nozzle by the vacuum created by the flow of the beverage and allowing the nozzle to drain fully.

8. A dispense head comprising an inlet for connection to a beverage supply line, said inlet communicating with a dispense valve opening to a dispense nozzle having an outlet, and means for draining said dispense nozzle downstream from said dispense valve through said dispense nozzle outlet when said dispense valve is closed, said draining means including means for admitting air to said dispense nozzle downstream from said dispense valve and upstream from said outlet, wherein said means for admitting air comprises an air inlet to said dispense nozzle upstream from the said outlet for admitting air into said dispense nozzle to drain said dispense nozzle on completion of a dispense.

9. A dispense head comprising an inlet for connection to a beverage supply line, said inlet communicating with a dispense valve opening to a dispense nozzle, and means for draining said dispense nozzle downstream from said dispense valve when said dispense valve is closed, wherein said drain means comprises an inlet for admitting air to drain said dispense nozzle on completion of a dispense, wherein said inlet for admitting air comprises a passageway controlled by a drain valve that is closed to prevent air being drawn into said nozzle during beverage dispense, and wherein a short time delay is provided on completion of a dispense before opening said drain valve.

10. A dispense head comprising an inlet for connection to a beverage supply line, said inlet communicating with a dispense valve opening to a dispense nozzle having a lower beverage outlet, and means for draining said dispense nozzle downstream of said dispense valve when said dispense valve is closed, wherein said drain means comprises an inlet for admitting air to said dispense nozzle upstream from said outlet to drain said dispense nozzle through said lower beverage outlet on completion of a dispense, and wherein said inlet for admitting air comprises a passageway controlled by a drain valve that is closed to prevent air being drawn into said nozzle during beverage dispense.

* * * * *

UNITED STATES PATENT AND TRADEMARK OFFICE

CERTIFICATE OF CORRECTION

PATENT NO. : 7,320,414 B2
APPLICATION NO. : 10/615997
DATED : January 22, 2008
INVENTOR(S) : Terrence Robert Davis It is certified that error appears in the above-identified patent and that said Letters Patent is hereby corrected as shown below:

Column 12, line 60, delete "the"

Signed and Sealed this

Twentieth Day of May, 2008

JON W. DUDAS
*Director of the United States Patent and Trademark Office*